US010017340B2

(12) United States Patent
Matsuoka et al.

(10) Patent No.: US 10,017,340 B2
(45) Date of Patent: Jul. 10, 2018

(54) SHEET CONVEYANCE APPARATUS AND SHEET CONVEYANCE METHOD

(71) Applicants: Tadashi Matsuoka, Kanagawa (JP); Yasuo Niikura, Kanagawa (JP); Yousuke Edo, Kanagawa (JP); Satoru Takano, Kanagawa (JP); Yasunori Hino, Kanagawa (JP); Atsunori Yoshida, Kanagawa (JP); Ryo Kanno, Kanagawa (JP); Hikaru Fukasawa, Kanagawa (JP)

(72) Inventors: Tadashi Matsuoka, Kanagawa (JP); Yasuo Niikura, Kanagawa (JP); Yousuke Edo, Kanagawa (JP); Satoru Takano, Kanagawa (JP); Yasunori Hino, Kanagawa (JP); Atsunori Yoshida, Kanagawa (JP); Ryo Kanno, Kanagawa (JP); Hikaru Fukasawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/375,945

(22) Filed: Dec. 12, 2016

(65) Prior Publication Data

US 2017/0174454 A1 Jun. 22, 2017

(30) Foreign Application Priority Data

Dec. 16, 2015 (JP) ..... 2015-245697
Oct. 19, 2016 (JP) ..... 2016-205519

(51) Int. Cl.
*B65H 3/12* (2006.01)
*B41J 29/377* (2006.01)
(Continued)

(52) U.S. Cl.
CPC ..... *B65H 3/128* (2013.01); *B41J 29/377* (2013.01); *B41J 29/38* (2013.01); *B65H 1/08* (2013.01);
(Continued)

(58) Field of Classification Search
CPC ..... B65H 3/0816; B65H 3/128; B65H 3/14; B65H 3/48; B65H 7/16
(Continued)

(56) References Cited

U.S. PATENT DOCUMENTS 6,186,491 B1 * 2/2001 Tomiyama ..... B65H 1/025 271/10.03
8,955,835 B2 2/2015 Satoh et al.
(Continued)

FOREIGN PATENT DOCUMENTS

CN 101266427 B 9/2010
JP 2006-182458 A 7/2006
(Continued)

OTHER PUBLICATIONS

Office Action dated Jun. 26, 2017 in Taiwanese Patent Application No. 105140849 (with English translation).
(Continued)

*Primary Examiner* — David H Bollinger
(74) *Attorney, Agent, or Firm* — Oblon, McClelland, Maier & Neustadt, L.L.P.

(57) ABSTRACT

A sheet conveyance apparatus includes: a placement part configured such that stacked sheets are disposed on the placement part; a housing including an open/close part and accommodating the placement part, at least a portion of the open/close part being configured to be opened and closed; and a suction unit connected with the housing, and configured to draw gas from an interior of the housing.

16 Claims, 10 Drawing Sheets

(51) Int. Cl.

| | |
|---|---|
| ***B65H 1/08*** | (2006.01) |
| ***B65H 3/48*** | (2006.01) |
| ***B41J 29/38*** | (2006.01) |
| *B41J 2/175* | (2006.01) |

(52) U.S. Cl.
CPC ..... *B65H 3/48* (2013.01); *B41J 2002/17569* (2013.01)

(58) Field of Classification Search
USPC ..... 271/98, 94, 96
See application file for complete search history.

(56) References Cited

U.S. PATENT DOCUMENTS

| | | | | |
|---|---|---|---|---|
| 9,260,264 | B2 | 2/2016 | Hoshino et al. | |
| 2007/0052152 | A1* | 3/2007 | Gruntjes ..... | B65H 1/16 271/97 |
| 2010/0270730 | A1* | 10/2010 | Asari ..... | B65H 3/124 271/108 |
| 2012/0153556 | A1 | 6/2012 | Sugiyama et al. | |
| 2012/0267846 | A1 | 10/2012 | Nakada et al. | |
| 2012/0282004 | A1 | 11/2012 | Furuhashi et al. | |
| 2013/0113154 | A1 | 5/2013 | Furuhashi et al. | |
| 2013/0134659 | A1 | 5/2013 | Konno et al. | |
| 2013/0147105 | A1 | 6/2013 | Sugiyama et al. | |
| 2013/0175755 | A1 | 7/2013 | Machida et al. | |
| 2013/0228965 | A1 | 9/2013 | Hoshino et al. | |
| 2013/0236228 | A1 | 9/2013 | Nagasako et al. | |
| 2014/0011656 | A1 | 1/2014 | Niikura et al. | |
| 2014/0145395 | A1 | 5/2014 | Takano et al. | |
| 2014/0159301 | A1 | 6/2014 | Suzuki et al. | |
| 2015/0145199 | A1 | 5/2015 | Yoshida et al. | |
| 2015/0166280 | A1 | 6/2015 | Hino et al. | |
| 2015/0225191 | A1 | 8/2015 | Niikura et al. | |
| 2015/0253716 | A1 | 9/2015 | Nagasako et al. | |
| 2016/0016740 | A1 | 1/2016 | Niikura et al. | |
| 2016/0107853 | A1 | 4/2016 | Hashimoto et al. | |
| 2016/0107854 | A1 | 4/2016 | Hashimoto et al. | |
| 2016/0122144 | A1 | 5/2016 | Fukumoto et al. | |
| 2016/0185552 | A1 | 6/2016 | Hoshino et al. | |
| 2016/0264370 | A1 | 9/2016 | Okutsu et al. | |

FOREIGN PATENT DOCUMENTS

| | | |
|---|---|---|
| JP | 2014-169182 | 9/2014 |
| JP | 2015-120602 | 7/2015 |
| JP | 2016-124707 | 7/2016 |

OTHER PUBLICATIONS

Combined Taiwanese Office Action and Search Report dated Nov. 7, 2017 in Patent Application No. 105140849 (with English language translation of Office Action and English translation of categories of cited documents).

* cited by examiner

SHEET CONVEYANCE APPARATUS AND SHEET CONVEYANCE METHOD

CROSS-REFERENCE TO RELATED APPLICATIONS

The present application claims priority under 35 U.S.C. § 119 to Japanese Patent Application No. 2015-245697, filed Dec. 16, 2015 and Japanese Patent Application No. 2016-205519, filed Oct. 19, 2016. The contents of which are incorporated herein by reference in their entirety.

BACKGROUND OF THE INVENTION

1. Field of the Invention

The present invention relates to a sheet conveyance apparatus and a sheet conveyance method.

2. Description of the Related Art

Known sheet conveyance apparatuses that convey sheets are either an air-assisted type or an air conveyance type, for example. An air-assisted sheet conveyance apparatus jets air from a side of a sheet to float the sheet and causes a roller or the like included therein to convey the sheet. An air conveyance type sheet conveyance apparatus blows air against an end portion of a sheet bundle to float a plurality of sheets and causes a suction conveyance belt disposed above the sheet bundle to attract and convey only one sheet.

Japanese Unexamined Patent Application Publication No. 2015-120602, for example, discloses a technique that uses blown air to collect foreign matter including paper dust and a surface coat.

The technique disclosed in Japanese Unexamined Patent Application Publication No. 2015-120602, however, entails a possibility that the foreign matter may be airborne inside and outside the sheet conveyance apparatus.

SUMMARY OF THE INVENTION

According to one aspect of the present invention, a sheet conveyance apparatus includes a placement part, a housing, and a suction unit. The placement part is configured such that stacked sheets are disposed on the placement part. The housing includes an open/close part and accommodates the placement part. At least a portion of the open/close part is configured to be opened and closed. The suction unit is connected with the housing, and configured to draw gas from an interior of the housing.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
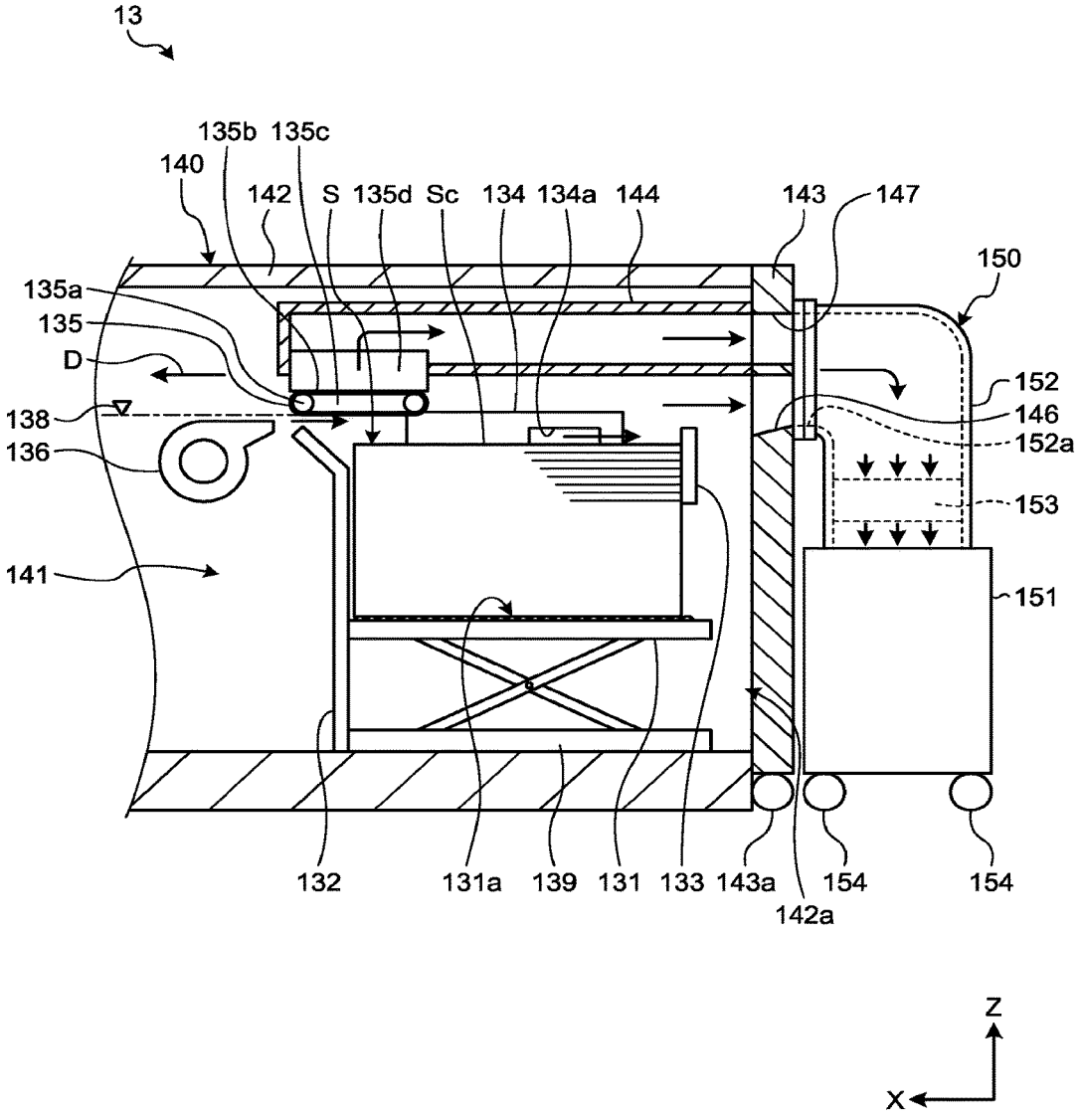
FIG. 1 is a sectional view schematically illustrating part of a sheet conveyance apparatus according to a first embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to provide a sheet conveyance apparatus and a sheet conveyance method that prevent foreign matter from being airborne.

First Embodiment

The following describes, with reference to FIGS. 1 to 7, a first embodiment. It is noted that some elements in the embodiments below and descriptions thereof may be expressed herein in several ways, which does not exclude any other expression not used herein to express these embodiments and descriptions thereof. Furthermore, some elements and descriptions thereof may be expressed with herein no alternative explicitly mentioned, which does not exclude any other expression not used herein to express these embodiments and descriptions thereof.

Figure 2:
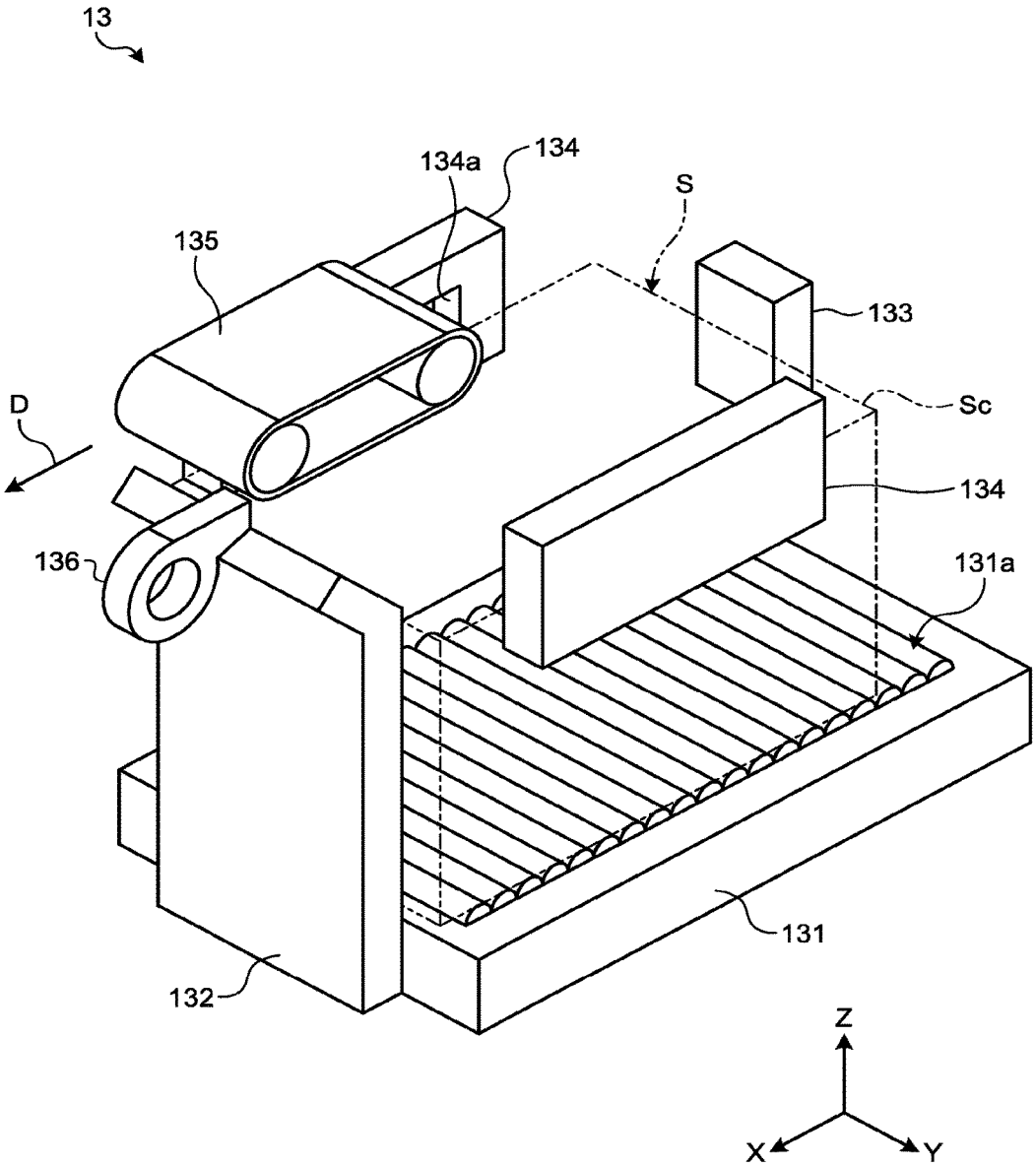
FIG. 2 is a perspective view schematically illustrating part of the inside of the sheet conveyance apparatus according to the first embodiment.
Figure 3:
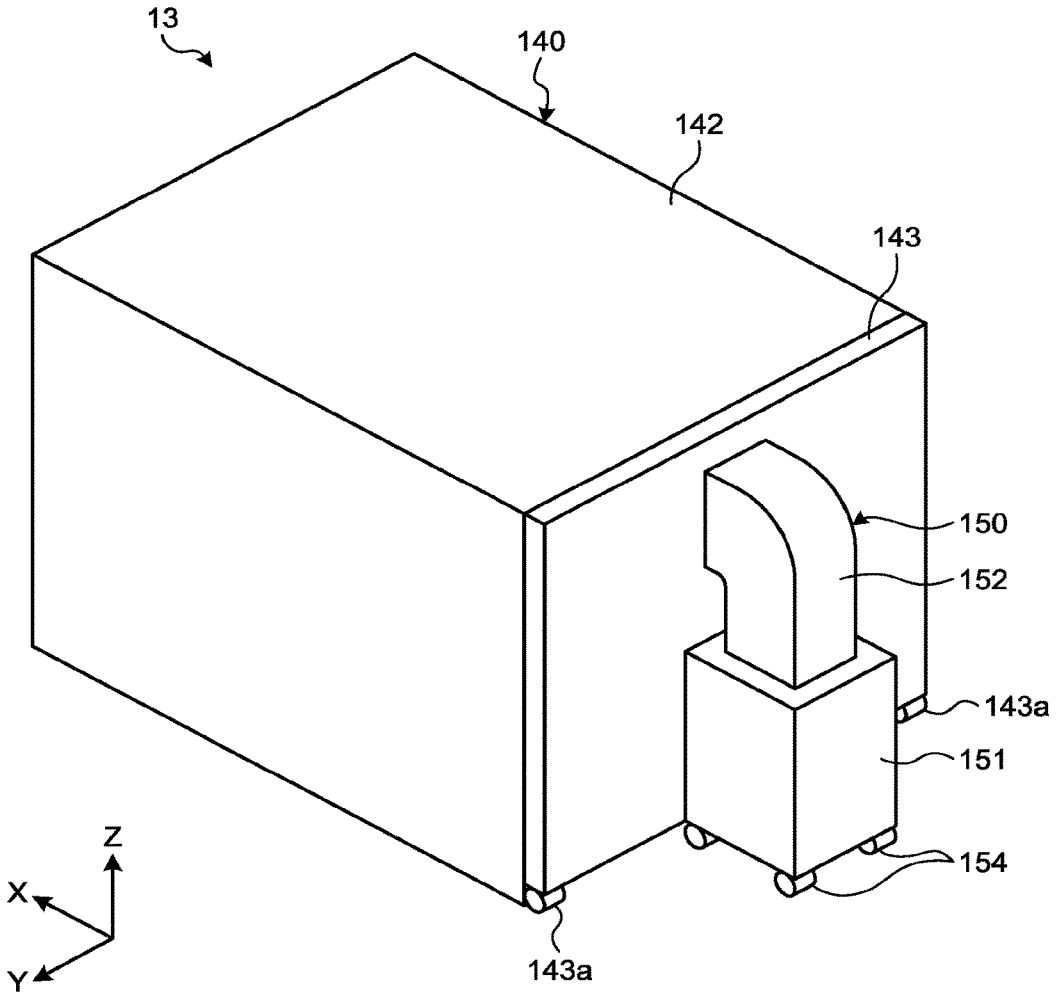
FIG. 3 is a perspective view schematically illustrating the sheet conveyance apparatus according to the first embodiment.

FIG. 1 is a sectional view schematically illustrating part of a sheet conveyance apparatus 13 according to the first embodiment. FIG. 2 is a perspective view schematically illustrating part of the inside of the sheet conveyance apparatus 13 according to the first embodiment. FIG. 3 is a perspective view schematically illustrating the sheet conveyance apparatus 13 according to the first embodiment. The sheet conveyance apparatus 13 conveys prepregs as an exemplary sheet.

The prepregs as an object to be conveyed in the first embodiment include all types of prepregs hitherto known. Examples of the prepregs in the first embodiment include, but are not limited to, a sheet-shaped reinforced plastic molding material that represents, for example, a fibrous reinforcing material, such as carbon fiber and glass cloth, impregnated with a thermally curable resin composition mixed with a hardener, a colorant, and other additives and heated or dried to a semi-cured state.

As illustrated in FIGS. 1 to 3, the sheet conveyance apparatus 13 includes a loading stand 131, a front fence 132, an end fence 133, a pair of side fences 134, a suction conveyance belt 135, an air jet unit 136, a conveyance sensor 138, and an elevator 139.

The loading stand 131 is an exemplary placement part. The end fence 133 is an exemplary limiting part. The suction conveyance belt 135 is an exemplary holding member and an exemplary conveyance member. The side fences 134 and the air jet unit 136 are an exemplary air jet unit.

As indicated in the accompanying drawings, an X-axis, a Y-axis, and a Z-axis are defined in this specification. The X-axis, the Y-axis, and the Z-axis are orthogonal to each other. The X-axis corresponds to a conveyance direction in which sheets are conveyed. The Y-axis corresponds to a width direction of the sheets loaded, stacked, and disposed on the loading stand 131 of the sheet conveyance apparatus 13. The Z-axis corresponds to a loading, stacking, and disposing direction of the sheets loaded, stacked, and disposed on the loading stand 131 of the sheet conveyance apparatus 13.

A sheet bundle S illustrated in FIG. 1 is a plurality of sheets (prepregs) stacked one on top of another. The sheet bundle S is loaded on the loading stand 131 in the sheet conveyance apparatus 13. To state the foregoing differently, the sheet bundle S including a plurality of sheets is disposed on the loading stand 131 in a stacked state.

The loading stand 131 can be moved by the elevator 139 in a direction in which the sheet bundle S is loaded (Z-axis direction). Moving the loading stand 131 by the elevator 139 results in the sheet bundle S loaded on the loading stand 131 and an uppermost sheet Sc being moved. A position of the loading stand 131 and a position of the uppermost sheet Sc are detected by, for example, a sensor and are thereby controlled. The uppermost sheet Sc is the farthest from the loading stand 131 among the sheets constituting the sheet bundle S.

The sheet conveyance apparatus 13 conveys the uppermost sheet Sc in a conveyance direction D. The conveyance direction D represents a direction in which the sheet conveyance apparatus 13 conveys the sheet Sc and corresponds to the X-axis.

The side fences 134 are disposed to be spaced apart from each other in the width direction of the sheet bundle S (Y-axis direction). The side fences 134 are disposed such that the sheet bundle S loaded on the loading stand 131 is positioned between the side fences 134. The side fences 134 position the sheet bundle S in the width direction that is orthogonal to the conveyance direction D.

The front fence 132 is disposed, in a downstream area in the conveyance direction D, so as to adjoin (be brought into contact with) an end portion (front end) of the sheet bundle S loaded on the loading stand 131. The front fence 132 restricts the sheet bundle S from moving downstream in the conveyance direction D, thereby positioning the front end of the sheet bundle S.

The end fence 133 is disposed, in an upstream area in the conveyance direction D, so as to adjoin (be brought into contact with) an end portion (rear end) of the sheet bundle S loaded on the loading stand 131. The end fence 133 restricts the sheet bundle S from moving upstream in the conveyance direction D, thereby positioning the rear end of the sheet bundle S.

Positions at which the side fences 134 are disposed can be varied in the width direction (Y-axis direction) of the sheet bundle S. A position at which the end fence 133 is disposed can be varied in the conveyance direction D (X-axis direction) of the sheets loaded, stacked, and disposed on the loading stand 131. The positions of the end fence 133 and the side fences 134 are varied according to, for example, a size of the sheet bundle S.

The side fences 134 are each provided with a side air nozzle 134*a*. The side air nozzles 134*a* each face the sheet bundle S. It is noted that the side air nozzle 134*a* may be disposed at any other position.

The suction conveyance belt 135 includes a plurality of rollers 135*a* and a belt 135*b*. For example, one of the rollers 135*a* is a drive roller and the other of the rollers 135*a* is a driven roller. The belt 135*b* is an endless belt member. The belt 135*b* is trained over the rollers 135*a* and rotatably driven by the rollers 135*a*.

The suction conveyance belt 135 has a chamber 135*c* disposed thereinside. The belt 135*b* has a plurality of holes that communicate with the chamber 135*c*. The chamber 135*c* is suctioned from an outside to maintain a negative pressure state, and the uppermost sheet Sc is sucked through the holes in the belt 135*b*.

The suction conveyance belt 135 includes an internal blower 135*d*. The internal blower 135*d* draws air through the holes in the belt 135*b* to thereby maintain a negative pressure state in the chamber 135*c*. The internal blower 135*d* can also maintain a high pressure state in the chamber 135*c* to thereby blow out air from the holes in the belt 135*b*.

The air jet unit 136 faces the front end of the sheet bundle S loaded on the loading stand 131. To state the foregoing differently, the air jet unit 136 is disposed downstream of the loading stand 131 in the conveyance direction D. The air jet unit 136 stores therein air that is a gas pressurized from the outside and sent thereto and ejects the air toward the sheet bundle S. The direction in which the air jet unit 136 ejects the air is required only to be opposite to the conveyance direction D. The direction is not necessarily required to extend in parallel with the conveyance direction D and may be oblique.

Examples of air as a gas include, but are not limited to, electrostatically discharged air and a gas used to float and separate sheets one from another. The prepregs that include carbon fiber, in particular, are hard to be separated from each other by electrostatic action between adjoining prepregs that are tightly sticking to each other. In this case, the air jet unit 136 may blow electrostatically discharged air against the sheet bundle S in the stacked state.

The air jet unit 136 blows the air toward the front end of the sheet bundle S to float at least one sheet separated from the sheet bundle S. It is noted that use of hot blown air achieves an additional dehumidifying effect for the sheets, so that the sheets can be more effectively separated from each other.

The air jet unit 136 can suspend ejection of the air. For example, the air jet unit 136 may plug an opening (nozzle) from which the air is ejected to thus suspend ejection of the air. The air jet unit 136 may use another method to suspend the ejection of the air.

The air jet unit 136 blows the air toward a front end face of the sheet bundle S loaded on the loading stand 131 to float at least one sheet including the uppermost sheet Sc up to a height of the suction conveyance belt 135.

The internal blower 135*d* operates as the sheet is floated to thereby bring the inside of the chamber 135*c* of the suction conveyance belt 135 into a negative pressure state.

As a result, the uppermost sheet Sc is attracted by the suction conveyance belt 135. To state the foregoing differently, the suction conveyance belt 135 holds the uppermost sheet Sc that has been floated by the air jet unit 136.

Another sheet may stick to the uppermost sheet Sc held by the suction conveyance belt 135. The side fences 134 each cause the side air nozzle 134*a* to eject the air to thereby separate the sheet Sc held by the suction conveyance belt 135 from the other sheet.

The suction conveyance belt 135 conveys the sheet Sc held thereby onto a conveyance destination. The conveyance direction D is the direction in which the suction conveyance belt 135 conveys the sheet Sc.

Reference is made to FIG. 1. The sheet conveyance apparatus 13 includes a cover 140 and a suction unit 150. The cover 140 is an exemplary housing. The suction unit 150 is an exemplary suction unit.

The cover 140 serves as a cabinet for the sheet conveyance apparatus 13. It is noted that the cover 140 may be a cabinet for an apparatus including the sheet conveyance apparatus 13. The cover 140 has a housing chamber 141 provided thereinside. The housing chamber 141 is an exemplary interior of the housing.

The loading stand 131, the front fence 132, the end fence 133, the pair of side fences 134, the suction conveyance belt 135, the air jet unit 136, the conveyance sensor 138, and the elevator 139 are housed in the housing chamber 141 inside the cover 140. To state the foregoing differently, the cover 140 covers the loading stand 131, the front fence 132, the end fence 133, the pair of side fences 134, the suction conveyance belt 135, the air jet unit 136, the conveyance sensor 138, and the elevator 139. It is noted that at least one of the conveyance sensor 138 and the elevator 139 may be disposed outside the housing chamber 141. Additionally, part of the loading stand 131, the front fence 132, the end fence 133, the pair of side fences 134, the suction conveyance belt 135, and the air jet unit 136 may be disposed outside the housing chamber 141.

The cover 140 includes a housing member 142, a door 143, and an internal duct 144. The housing member 142 is also an exemplary housing. The door 143 is an exemplary open/close part. The housing chamber 141 is disposed in an interior of the housing member 142.

The housing member 142 has a loading port 142*a* formed therein. The loading port 142*a* assumes an opening through which the sheet bundle S or at least one sheet constituting the sheet bundle S can pass. Specifically, the housing member 142 is formed into a box having an open part. The loading port 142*a* is disposed upstream of the loading stand 131 in the conveyance direction D.

The door 143 is removably attached to the housing member 142 and closes the loading port 142*a*. To state the foregoing differently, the door 143 is mounted on the cover 140 and can be opened and closed. For example, the door 143 is removed from the housing member 142 to thereby open the housing chamber 141 of the cover 140. Alternatively, the door 143 is attached to the housing member 142 to thereby close the housing chamber 141 of the cover 140.

The door 143 is rotatably attached to the housing member 142 by, for example, a hinge. The door 143 is rotated with respect to the housing member 142 to thereby be able to open or close the housing chamber 141. The rotatability of the door 143 is nonetheless illustrative only and not limiting. The door 143 may, for example, be moved in parallel to be capable of opening or closing the housing chamber 141.

The door 143 is disposed upstream of the loading stand 131 in the conveyance direction D. The door 143 is disposed upstream of the end fence 133 in the conveyance direction D. The door 143 is disposed to be spaced away from the end fence 133. The door 143 may nonetheless be in contact with the end fence 133.

The door 143 has a first suction port 146 and a second suction port 147. The first suction port 146 is an exemplary suction port. The first suction port 146 and the second suction port 147 are adjacent to each other. At least part of the first suction port 146 is disposed superior to the uppermost sheet Sc (in a direction away from the loading stand 131). The first suction port 146 and the second suction port 147 are each open to the housing chamber 141 inside the cover 140 and to the outside of the cover 140.

The first suction port 146 and the second suction port 147 are disposed upstream of the end fence 133 in the conveyance direction D. The first suction port 146 and the second suction port 147 may be disposed at any other portions in the cover 140.

The internal duct 144 is housed in the housing chamber 141 inside the cover 140. The internal duct 144 connects the internal blower 135*d* of the suction conveyance belt 135 with the second suction port 147. When the internal blower 135*d* draws air through the holes in the belt 135*b*, the air flows through the internal duct 144 toward the second suction port 147.

The suction unit 150 is removably attached to the cover 140. The suction unit 150 includes an external blower 151, an external duct 152, a filter 153, and a plurality of casters 154. The filter 153 is an exemplary filter.

The external blower 151 is connected with the housing chamber 141 inside the cover 140 through the external duct 152, the first suction port 146, and the second suction port 147. The external blower 151 draws air in the housing chamber 141 through the first suction port 146. The external blower 151 also draws air in the internal duct 144 through the second suction port 147. Thus, the external blower 151 can draw air in the housing chamber 141 through the second suction port 147, the internal duct 144, and the holes in the belt 135*b* of the suction conveyance belt 135.

Preferably, the external blower 151 is disposed such that air is drawn in a direction opposite (downwardly) to the loading, stacking, and disposing direction of the sheets (Z-axis direction). The direction in which the external blower 151 draws air is not necessarily required to extend in parallel with the downward direction and may be oblique. Setting the direction in which the external blower 151 draws air opposite to the loading, stacking, and disposing direction of the sheets achieves an effect of being able to continue drawing air even when a large amount of foreign matter, such as sheet (prepreg) material powder, dust, and dirt, is deposited on the filter 153.

The external duct 152 is removably attached to the door 143 of the cover 140. The external duct 152 may be attached to any other portion of the cover 140. The external duct 152 has a connection port 152*a*. The connection port 152*a* is connected with the first suction port 146 and the second suction port 147. Specifically, the first suction port 146 and the second suction port 147 join each other at the connection port 152*a*.

Figure 4:
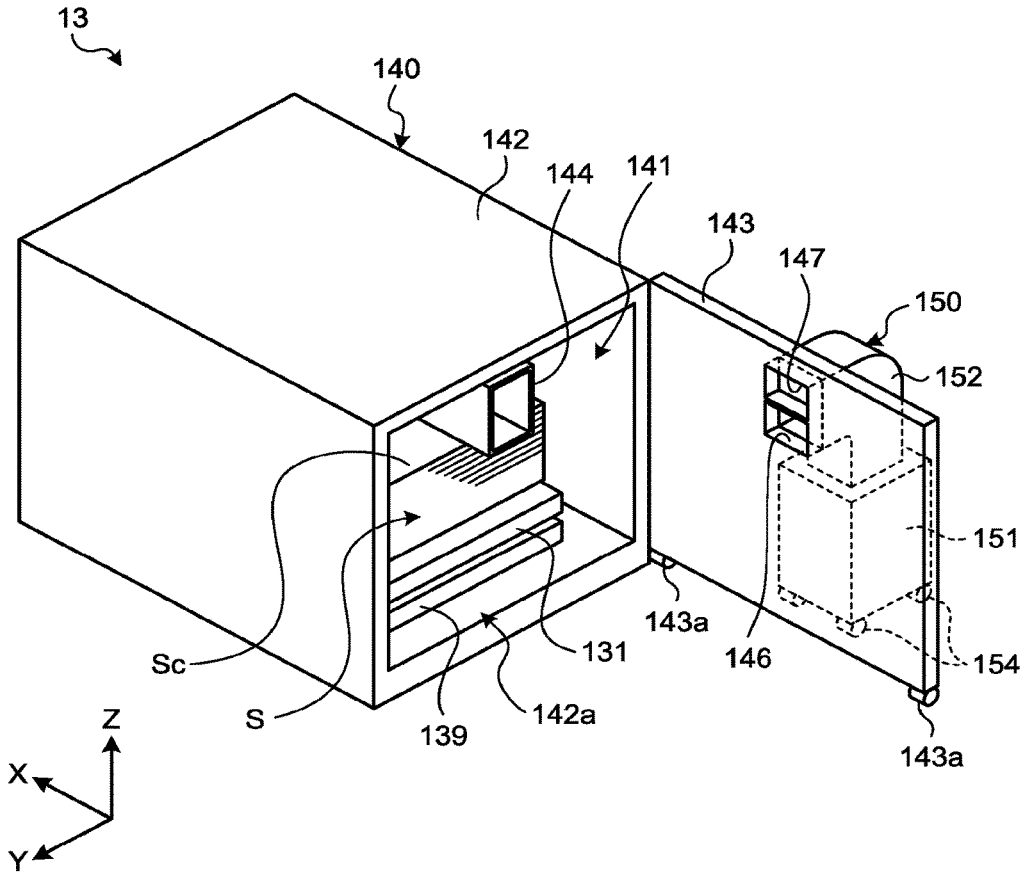
FIG. 4 is a sectional view schematically illustrating part of the sheet conveyance apparatus according to the first embodiment with a door removed.

FIG. 4 is a sectional view schematically illustrating part of the sheet conveyance apparatus 13 according to the first embodiment with the door 143 removed. The external duct 152 is attached to the door 143 as illustrated in FIG. 4. Thus, the suction unit 150 moves following opening and closing of the door 143. For example, when the door 143 is removed from the housing member 142 to thereby open the housing chamber 141, the suction unit 150 is removed together with the door 143 from the housing member 142. When the door 143 is attached to the housing member 142 to thereby close the housing chamber 141, the suction unit 150 is attached to the housing member 142 together with the door 143.

As illustrated in FIG. 1, the filter 153 is removably mounted inside the external duct 152. The filter 153 removes foreign matter, such as sheet (prepreg) material powder, dust, and dirt from the air in the housing chamber 141 and the internal duct 144 drawn by the external blower 151. Examples of the foreign matter mentioned above are illustrative only and include any object that is different from the sheet as the object to be conveyed.

Removal of the external duct 152 from the door 143 exposes the connection port 152*a* to the outside. The filter 153 can be removed from the external duct 152 through the exposed connection port 152*a*. Additionally, the filter 153 can be attached inside the external duct 152 through the connection port 152*a*.

The casters 154 are attached to the external blower 151. The casters 154 support the external blower 151 movably. The casters 154 enable the suction unit 150 that has been removed from the door 143 to move smoothly.

Additionally, the casters 154 and a plurality of casters 143*a* disposed on the door 143 enable the door 143 removed from the housing member 142, and the suction unit 150 to move smoothly.

Figure 5:
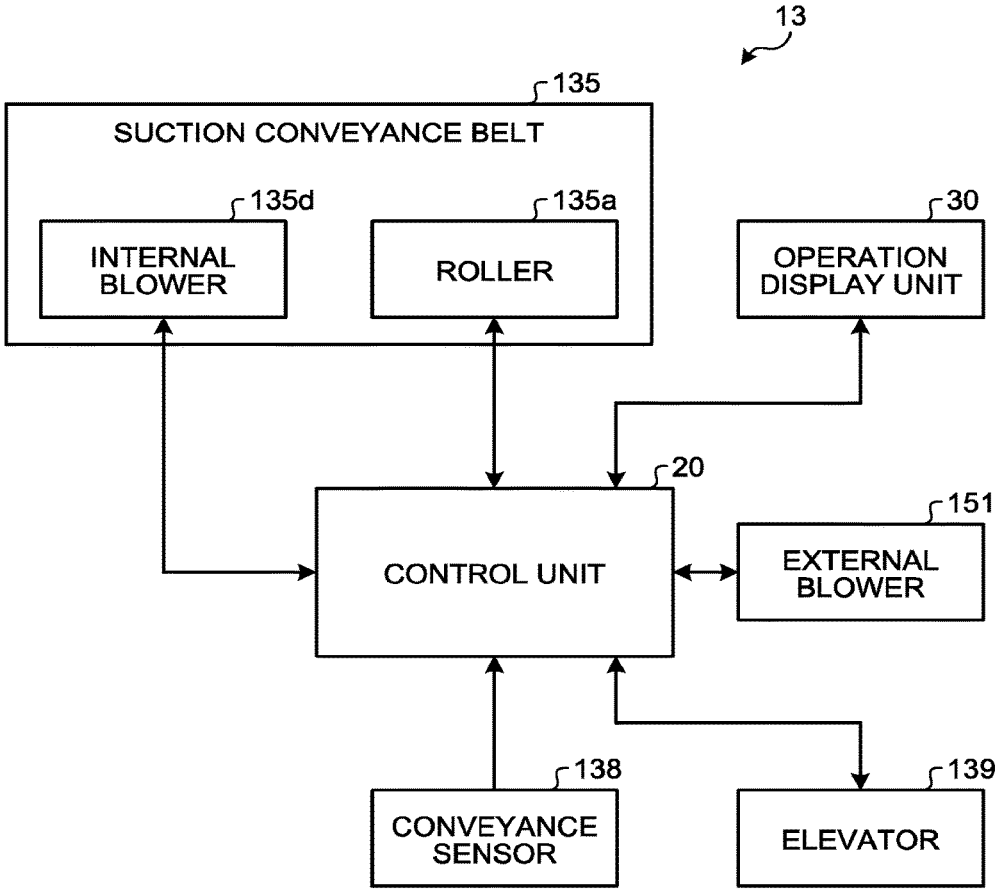
FIG. 5 is a block diagram illustrating an exemplary configuration of the sheet conveyance apparatus according to the first embodiment.

FIG. 5 is a block diagram illustrating an exemplary configuration of the sheet conveyance apparatus 13 according to the first embodiment. As illustrated in FIG. 5, the sheet conveyance apparatus 13 further includes a control unit 20 and an operation display unit 30.

The control unit 20 controls, for example, the operation display unit 30, the rollers 135*a* and the internal blower 135*d* of the suction conveyance belt 135, the conveyance sensor 138, the elevator 139, and the external blower 151.

The control unit 20 includes a controller such as a CPU and a storage such as a ROM and a RAM. For example, the controller loads a program stored in the storage and executes the program to thereby enable the control unit 20 to control the operation display unit 30, the rollers 135*a* and the internal blower 135*d* of the suction conveyance belt 135, the conveyance sensor 138, the elevator 139, and the external blower 151. The control unit 20 may include a driver for controlling the operation display unit 30, the rollers 135*a* and the internal blower 135*d* of the suction conveyance belt 135, the conveyance sensor 138, the elevator 139, and the external blower 151.

The operation display unit 30 is, for example, an operation panel for the sheet conveyance apparatus 13, including a liquid crystal touch panel. The control unit 20 displays on the operation display unit 30 states of different units and parts and receives inputs of information from an operator.

Figure 6:
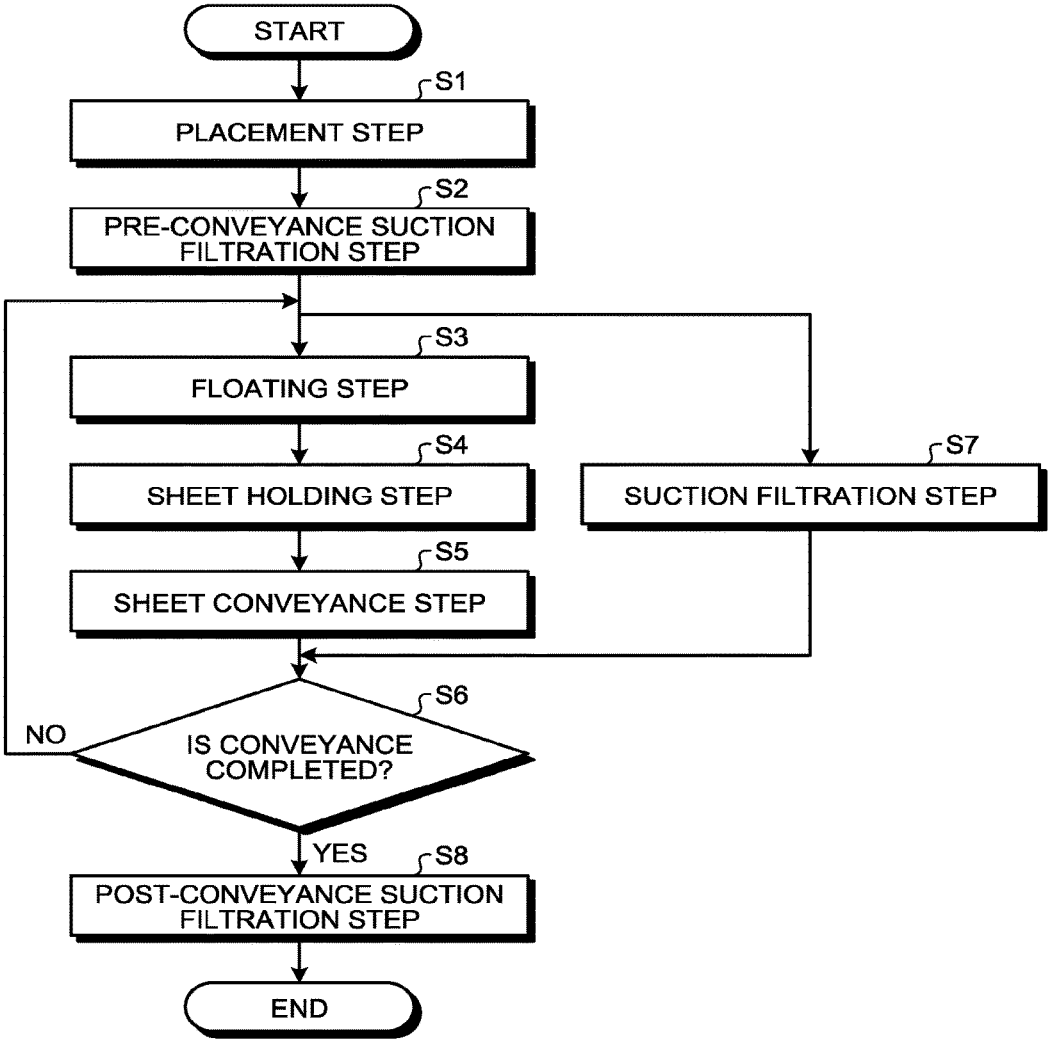
FIG. 6 is a flowchart illustrating at least part of a process performed by the sheet conveyance apparatus according to the first embodiment.

The following exemplifies part of a sheet conveyance method performed by the sheet conveyance apparatus 13. It is noted that the sheet conveyance method to be described below is illustrative only and the sheet conveyance apparatus 13 may perform another method to convey the sheets. FIG. 6 is a flowchart illustrating at least part of a process performed by the sheet conveyance apparatus 13 according to the first embodiment.

A placement step (S1) in which the sheet bundle S is disposed on the loading stand 131 is performed. For example, the operator removes the door 143 from the housing member 142 to open the housing chamber 141. The sheet bundle S in a stacked state is loaded on the loading stand 131 by way of the loading port 142*a* of the housing member 142.

The front end face of the sheet bundle S is pressed up against the front fence 132, serving as a reference surface for correct alignment. The end fence 133 and the side fences 134 are operated, so that a rear end face and lateral end faces of the sheet bundle S are aligned, respectively.

As illustrated in FIG. 1, the loading stand 131 includes a plurality of transfer rollers 131*a*. The sheet bundle S is placed on the transfer rollers 131*a*. The transfer rollers 131*a* transfer the sheet bundle S toward the front fence 132 to thereby bring the front end face of the sheet bundle S into abutment against the front fence 132.

At the placement step, a robot or a special-purpose device, for example, instead of the operator may place the sheet bundle S on the loading stand 131 and align the front end face, the lateral end faces, and the rear end face of the sheet bundle S. Alternatively, the control unit 20 may, for example, drive the transfer rollers 131*a* to thereby cause the transfer rollers 131*a* to transfer the sheet bundle S stored in another place onto the loading stand 131.

When the sheet bundle S is disposed on the loading stand 131, the door 143 is attached to the housing member 142 and the housing chamber 141 is thereby closed. The suction unit 150 is connected with the housing chamber 141 through the first suction port 146 that is open in the door 143.

When, for example, the operator inputs information in the control unit 20 via the operation display unit 30, a pre-conveyance suction filtration step (S2) is performed. The air jet unit 136, the side air nozzles 134*a* of the side fences 134, and the internal blower 135*d* of the suction conveyance belt 135, having received command signals from the control unit 20, supplies the housing chamber 141 with air that is a gas. As such, the air jet unit 136, the side air nozzles 134*a*, and the suction conveyance belt 135 can supply the housing chamber 141 with the air.

For example, the air jet unit 136 and the side air nozzles 134*a* each supply the housing chamber 141 with the air. The internal blower 135*d* supplies the housing chamber 141 with the air through the chamber 135*c* and the holes in the belt 135*b*.

Figure 7:
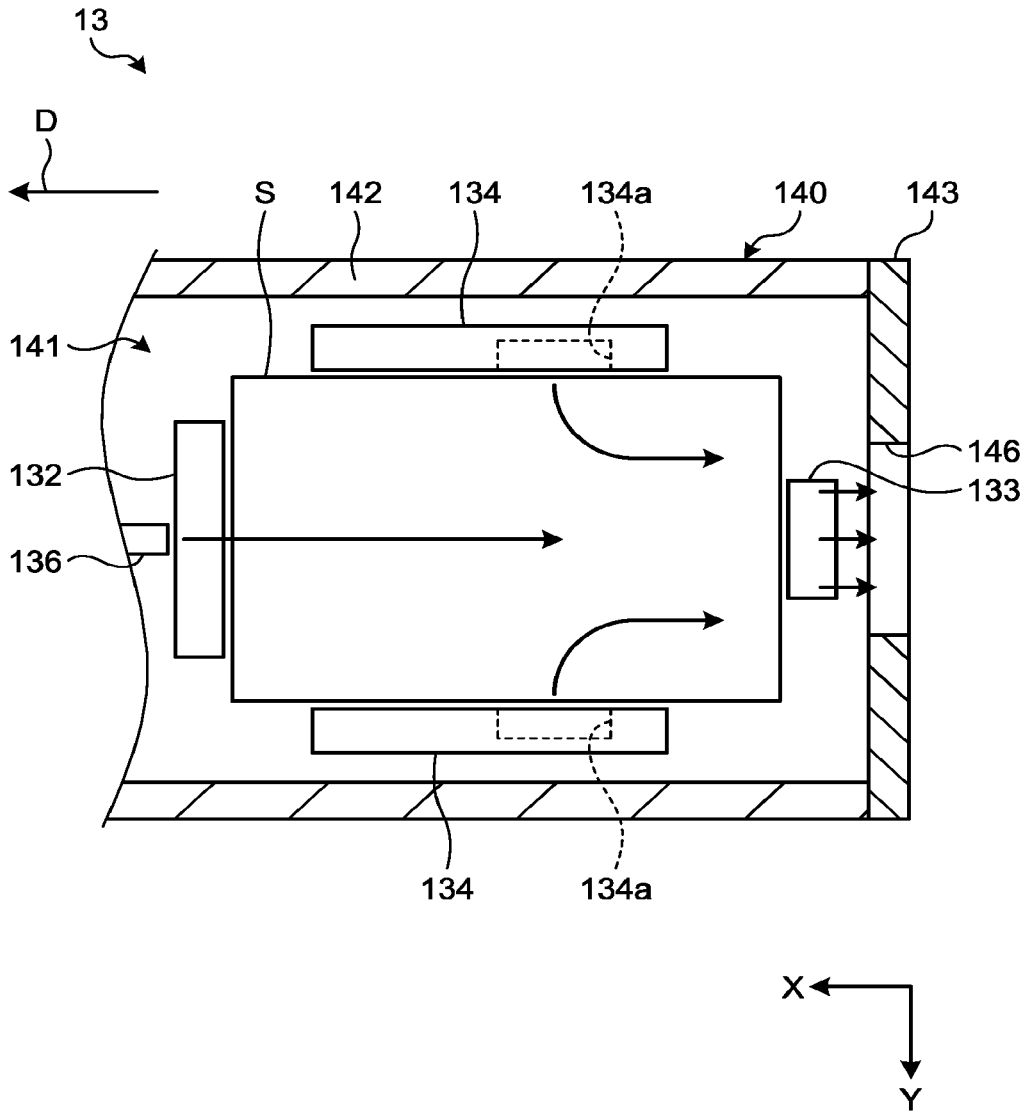
FIG. 7 is a sectional view schematically illustrating part of the sheet conveyance apparatus according to the first embodiment as viewed from above.

FIG. 7 is a sectional view schematically illustrating part of the sheet conveyance apparatus 13 according to the first embodiment as viewed from above. The external blower 151, having received a command signal from the control unit 20, draws air in the housing chamber 141 through the external duct 152, the connection port 152*a*, and the first suction port 146. As a result, air flows, in the housing chamber 141, from the air jet unit 136, the side air nozzles 134*a*, and the suction conveyance belt 135 toward the first suction port 146, as indicated by the arrows in FIG. 7.

Foreign matter, such as sheet (prepreg) material powder, dust, and dirt, may be deposited on or may stick to the upper surface of the sheet bundle S and may be airborne inside the housing chamber 141. The flow of air in the housing chamber 141 causes the air and foreign matter to be drawn through the first suction port 146.

As illustrated in FIG. 1, the air and the foreign matter drawn through the first suction port 146 flow through the external duct 152. When the air flows through the filter 153 disposed inside the external duct 152, the filter 153 traps the foreign matter in the air. The air after the foreign matter has been removed by the filter 153 is drawn by the external blower 151. The external blower 151 is operated for a predetermined period of time. This operation of the external blower 151 removes foreign matter from the housing chamber 141.

In order to convey the sheets, the control unit 20 activates the air jet unit 136 and the side air nozzles 134*a* of the side fences 134. This activation starts a floating step (S3). The air jet unit 136 and the side air nozzles 134*a* blow air against the front end and the lateral ends of the sheet bundle S.

The air jet unit 136 blows air against the front end of at least one sheet including the uppermost sheet Sc out of the sheet bundle S disposed on the loading stand 131. In addition, the side air nozzles 134*a* of the side fences 134 blow air against the lateral ends of at least one sheet including the uppermost sheet Sc out of the sheet bundle S disposed on the loading stand 131. The foregoing operations float at least one sheet including the sheet Sc.

Simultaneously with the floating step (S3), a sheet holding step (S4) at which the floated sheet Sc is held is started. The operation of the internal blower 135*d* results in the suction conveyance belt 135 drawing air through the holes in the belt 135*b*. As a result, the uppermost sheet Sc is floated and further attracted and held in position by the suction conveyance belt 135.

Drive of the suction conveyance belt 135 is then started and a sheet conveyance step (S5) at which the sheet Sc held by the suction conveyance belt 135 is conveyed is performed. The sheet conveyance apparatus 13 may include a part that conveys or supports a sheet Sc after the suction conveyance belt 135 has conveyed the sheet Sc.

When the conveyance sensor 138 detects the sheet Sc, the control unit 20 stops rotational conveyance drive of the suction conveyance belt 135. The sheet Sc is fed onto, for example, another apparatus with the suction conveyance belt 135 remaining stationary.

When the sheet Sc leaves a holding area by the suction conveyance belt 135, the control unit 20 determines whether sheet conveyance is completed (S6). If the number of sheets that have been conveyed is yet to reach a set number (No at S6), the control unit 20 starts the floating step (S3) again. Specifically, the air jet unit 136 and the side air nozzles 134*a* blow air against a subsequent sheet Sc to float at least one sheet.

The floated subsequent sheet Sc is held by the suction conveyance belt 135 (S4). The control unit 20 restarts the drive of the suction conveyance belt 135 in accordance with set sheet conveyance intervals for the conveyance of the sheet Sc (S5). The steps from (S3) to (S6) are thus repeatedly performed to convey the sheets in sequence.

While the steps from (S3) to (S6) are performed, a suction filtration step (S7) is performed. For example, at the same time that the air jet unit 136 and the side air nozzles 134*a* float the sheet Sc first, the control unit 20 activates the external blower 151 of the suction unit 150. The external blower 151 draws air in the housing chamber 141 through the first suction port 146.

As illustrated in FIG. 7, the drawing of air by the external blower 151 results in the air blown by the air jet unit 136 and the side air nozzles 134*a* flowing toward the first suction port 146. As a result, the air blown by the air jet unit 136 and the side air nozzles 134*a* is smoothed, so that the air flows through from the front end toward the rear end of the sheet Sc. Thus, the air is prevented from disturbing posture of the sheet Sc.

In addition, the air blown by the air jet unit 136 and the side air nozzles 134*a* is drawn, together with foreign matter flying in the housing chamber 141 and foreign matter that exists between sheets, into the first suction port 146. The foreign matter is removed by the filter 153 as the air passes through the filter 153.

In addition, at the sheet holding step (S4), the internal blower 135*d* of the suction conveyance belt 135 draws air in the housing chamber 141 through the chamber 135*c* and the holes in the belt 135*b*. Thus, the foreign matter in the housing chamber 141 is also drawn by the internal blower 135*d*.

The air and the foreign matter drawn by the internal blower 135*d* flow through the internal duct 144 and into the external duct 152 of the suction unit 150 by way of the second suction port 147. The air and the foreign matter drawn through the second suction port 147 join the air and the foreign matter drawn through the first suction port 146 and are together filtered by the filter 153.

The foreign matter in the housing chamber 141 is, as described above, drawn by the suction unit 150 and filtered by the filter 153. During the steps from (S3) to (S6) described above, the control unit 20 causes the suction unit 150 to draw air in the housing chamber 141 at all times. The control unit 20 may instead cause the suction unit 150 to draw air in the housing chamber 141 only during a period of time over which the air jet unit 136 and the side air nozzles 134*a* blow air.

If the number of sheets that have been conveyed reaches the set number and the sheet conveyance is completed (Yes at S6), a post-conveyance suction filtration step (S8) is performed. As at the pre-conveyance suction filtration step (S2), the air jet unit 136, the side air nozzles 134*a*, and the internal blower 135*d* of the suction conveyance belt 135 supply the housing chamber 141 with the air. The external blower 151 draws air in the housing chamber 141 through the external duct 152, the connection port 152*a*, and the first suction port 146. This drawing of the air in the housing chamber 141 removes foreign matter in the housing chamber 141. The foregoing steps complete the sheet conveyance by the sheet conveyance apparatus 13.

At the pre-conveyance suction filtration step (S2) and the post-conveyance suction filtration step (S8), the air jet unit 136 and the side air nozzles 134*a* stop a sheet floating operation. Additionally, the suction conveyance belt 135 stops a sheet holding operation and a sheet conveyance operation. As such, the control unit 20 causes the suction unit 150 to draw air in the housing chamber 141 both during sheet conveyance (S3 to S7) and while the sheet conveyance is stopped (S2 and S8). It is noted that the control unit 20 is required only to cause the suction unit 150 to draw air in the housing chamber 141 at least one of the three timings of pre-conveyance of sheets (S2), during conveyance of sheets (S7), and post-conveyance of sheets (S8). The timings of pre-conveyance of sheets (S2) and post-conveyance of sheets (S8) include such timings as before shipment of the sheet conveyance apparatus 13 and during servicing after some time of sheet conveyance. The pre-conveyance suction filtration step (S2), the suction filtration step (S7), and the post-conveyance suction filtration step (S8) are each an exemplary suction step and an exemplary filtration step.

In the sheet conveyance apparatus 13 according to the first embodiment, at least the loading stand 131 is housed in the housing chamber 141 inside the cover 140. The suction unit 150 is connected with the cover 140 and draws air in the housing chamber 141. Specifically, foreign matter that exists between sheets or that is generated during sheet conveyance, such as the sheet material powder, is drawn from the interior inside the cover 140 by the suction unit 150. The filter 153 removes foreign matter from the air drawn by the suction unit 150. The foregoing operations prevent the foreign matter from being airborne inside and outside the sheet conveyance apparatus 13, prevent the foreign matter from being deposited on the inside and the outside of the cover 140, and reduce time required for cleaning the foreign matter.

The first suction port 146 through which the suction unit 150 draws air is disposed in the door 143 of the cover 140. The first suction port 146 can thus be formed even larger. As a result, the suction unit 150 can easily draw air and foreign matter generally in the housing chamber 141 through the first suction port 146.

The door 143 is disposed upstream of the loading stand 131 in the conveyance direction D in which the suction conveyance belt 135 conveys the sheet. This configuration enables the operator to readily load the sheet bundle S in the loading stand 131.

The suction unit 150 is attached to the door 143 and moves following opening and closing of the door 143. This arrangement results in the suction unit 150 being moved simultaneously with the opening and closing of the door 143, thus facilitating the loading of the sheet bundle S onto the loading stand 131 involving the opening and closing of the door 143.

The suction unit 150 can be removed from the cover 140. The removal of the suction unit 150 from the cover 140 exposes the connection port 152*a* connected with the first suction port 146 in the cover 140. The filter 153 can be removed from the suction unit 150 through the connection port 152*a*. Specifically, the removal of the suction unit 150 from the cover 140 allows the operator to remove the filter 153 by way of the connection port 152*a*. Thus, the filter 153 can be removed from the suction unit 150 without the need to disassemble the suction unit 150. This feature enhances maintainability of the sheet conveyance apparatus 13.

The control unit 20 causes the suction unit 150 to draw air in the housing chamber 141 during a sheet conveyance operation in which the air jet unit 136 and the side air nozzles 134*a* float the sheet and the suction conveyance belt 135 conveys the sheet. Thus, during the sheet conveyance operation, the foreign matter that exists between sheets or that is generated during the sheet conveyance, such as the sheet material powder, is removed from the interior inside the cover 140. The foreign matter is thus prevented from being airborne inside and outside the sheet conveyance apparatus 13, the foreign matter is prevented from being deposited on the inside and the outside of the cover 140, and time required for cleaning the foreign matter is reduced.

The control unit 20 causes the air jet unit 136, the side air nozzles 134*a*, and the suction conveyance belt 135 to supply air to the inside of the cover 140 and causes the suction unit 150 to draw air in the housing chamber 141 during a sheet floating operation in which the air jet unit 136 and the side air nozzles 134*a* float the sheet. Thus, the foreign matter including, for example, the sheet material powder deposited and accumulated on the inside of the cover 140 is removed from the inside of the cover 140. Time required for cleaning the foreign matter is thus reduced.

The suction unit 150 and the first suction port 146 are disposed upstream of the end fence 133 in the conveyance direction D. Specifically, the first suction port 146 is spaced away from the sheet bundle S. This arrangement allows the suction unit 150 to draw via the first suction port 146 air that flows not only between sheets, but also through various paths inside the cover 140. As a result, the suction unit 150 can draw air and foreign matter from generally inside the cover 140, so that the foreign matter can be prevented from being airborne inside and outside the sheet conveyance apparatus 13.

The suction unit 150 draws air in the housing chamber 141 through not only the first suction port 146, but also the suction conveyance belt 135. This arrangement enables the suction unit 150 to draw the air and foreign matter in the housing chamber 141 effectively, thus preventing the foreign matter from being airborne inside and outside the sheet conveyance apparatus 13.

Second Embodiment

Figure 8:
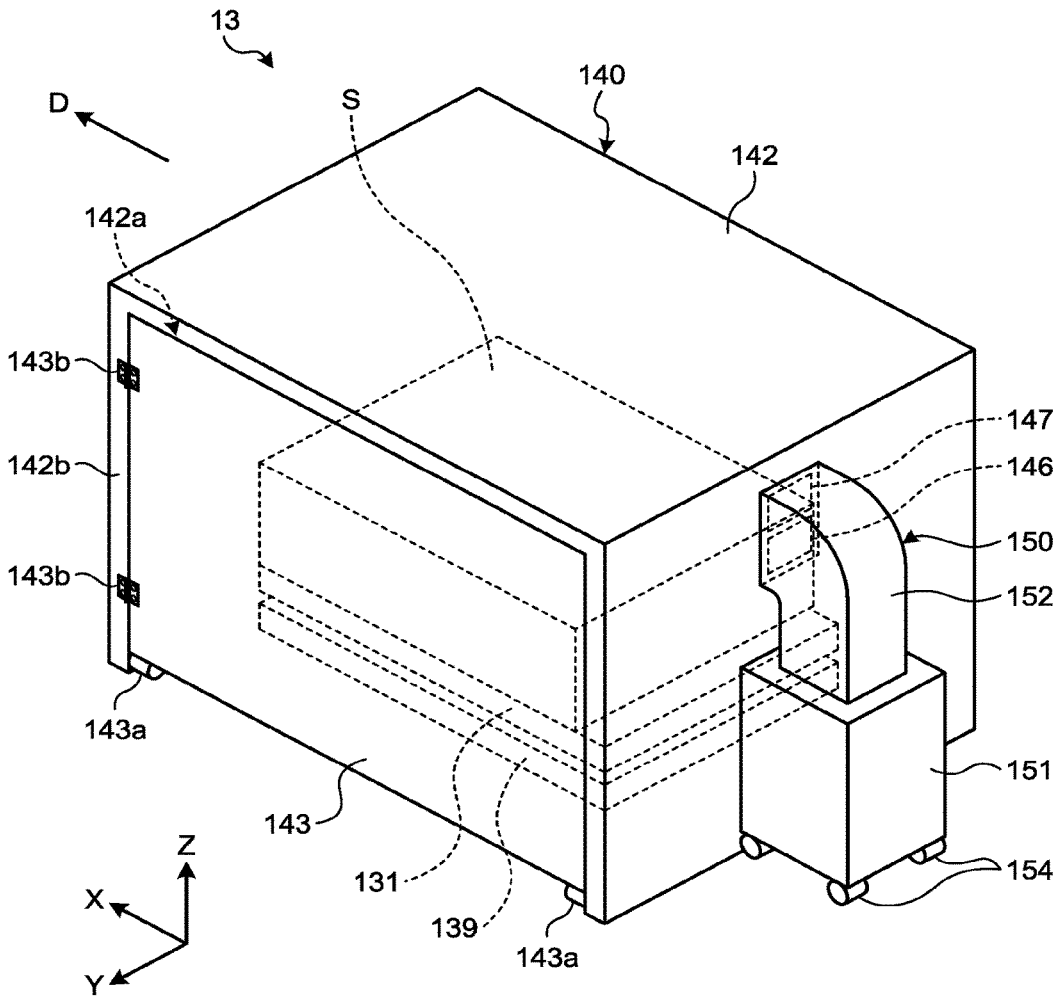
FIG. 8 is a perspective view schematically illustrating a sheet conveyance apparatus according to a second embodiment.
Figure 9:
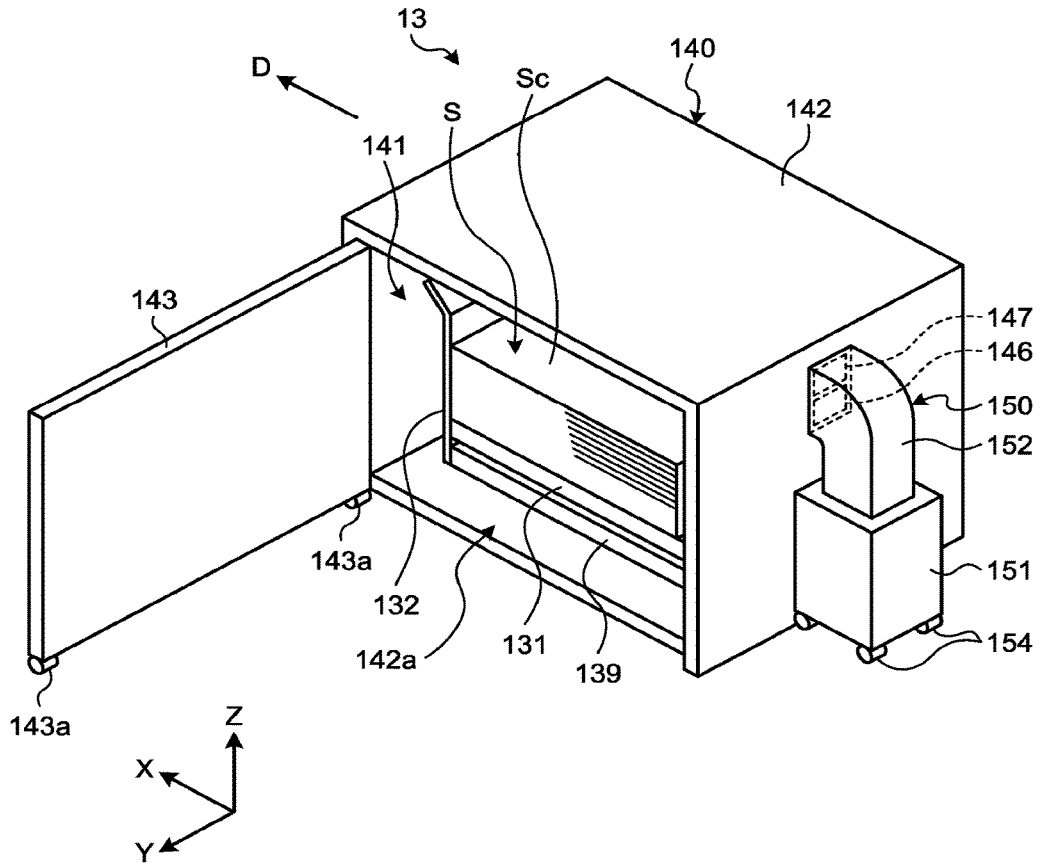
FIG. 9 is a perspective view schematically illustrating the sheet conveyance apparatus according to the second embodiment with a door removed.

The following describes a second embodiment with reference to FIGS. 8 and 9. In describing a plurality of embodiments hereunder, like or corresponding elements having functions identical to the functions of the elements described with reference to the first embodiment are identified by the same reference numerals as the elements used for the first embodiment and descriptions for those elements may be omitted. Not all elements identified by the same reference numerals have functions and properties in common and the elements may have functions and properties that are varied according to the specific embodiment.

FIG. 8 is a perspective view schematically illustrating a sheet conveyance apparatus 13 according to the second embodiment. FIG. 9 is a perspective view schematically illustrating the sheet conveyance apparatus 13 according to the second embodiment with a door 143 removed.

As illustrated in FIG. 8, the door 143 in the second embodiment is disposed laterally (in the Y-axis direction) with respect to a loading stand 131 in a conveyance direction D. More specifically, the door 143 is disposed on a lateral portion 142*b* of a housing member 142 in a direction orthogonal to the conveyance direction D. To state the foregoing differently, the door 143 is disposed in a direction that crosses (e.g., orthogonal to) the conveyance direction D deviated from the conveyance direction D with respect to the loading stand 131. A loading port 142*a* is also disposed laterally in the conveyance direction D with respect to the loading stand 131. The direction in which the door 143 and the loading port 142*a* are disposed is required only to be different from the conveyance direction D. The direction in which the door 143 and the loading port 142*a* are disposed may even be oblique, and does not necessarily have to be in parallel, with respect to the Y-axis direction.

As illustrated in FIG. 8, the door 143 is rotatably attached to the housing member 142 through, for example, hinges 143*b*. The rotatable motion of the door 143 with respect to the housing member 142 results in the door 143 being capable of opening or closing a housing chamber 141. The rotatability of the door 143 is nonetheless illustrative only and not limiting. The door 143 may, for example, be moved in parallel to be capable of opening or closing the housing chamber 141.

A first suction port 146 and a second suction port 147 are disposed upstream of the loading stand 131 in the conveyance direction D as in the first embodiment. The first suction port 146 and the second suction port 147 are disposed in the housing member 142.

In the sheet conveyance apparatus 13 according to the second embodiment, the first suction port 146 is disposed upstream of the loading stand 131 in the conveyance direction D. Meanwhile, the door 143 is disposed laterally with respect to the loading stand 131 in the conveyance direction D. As illustrated in FIG. 9, these arrangements allow the operator to open or close the door 143 without the need to move a suction unit 150.

Third Embodiment

Figure 10:
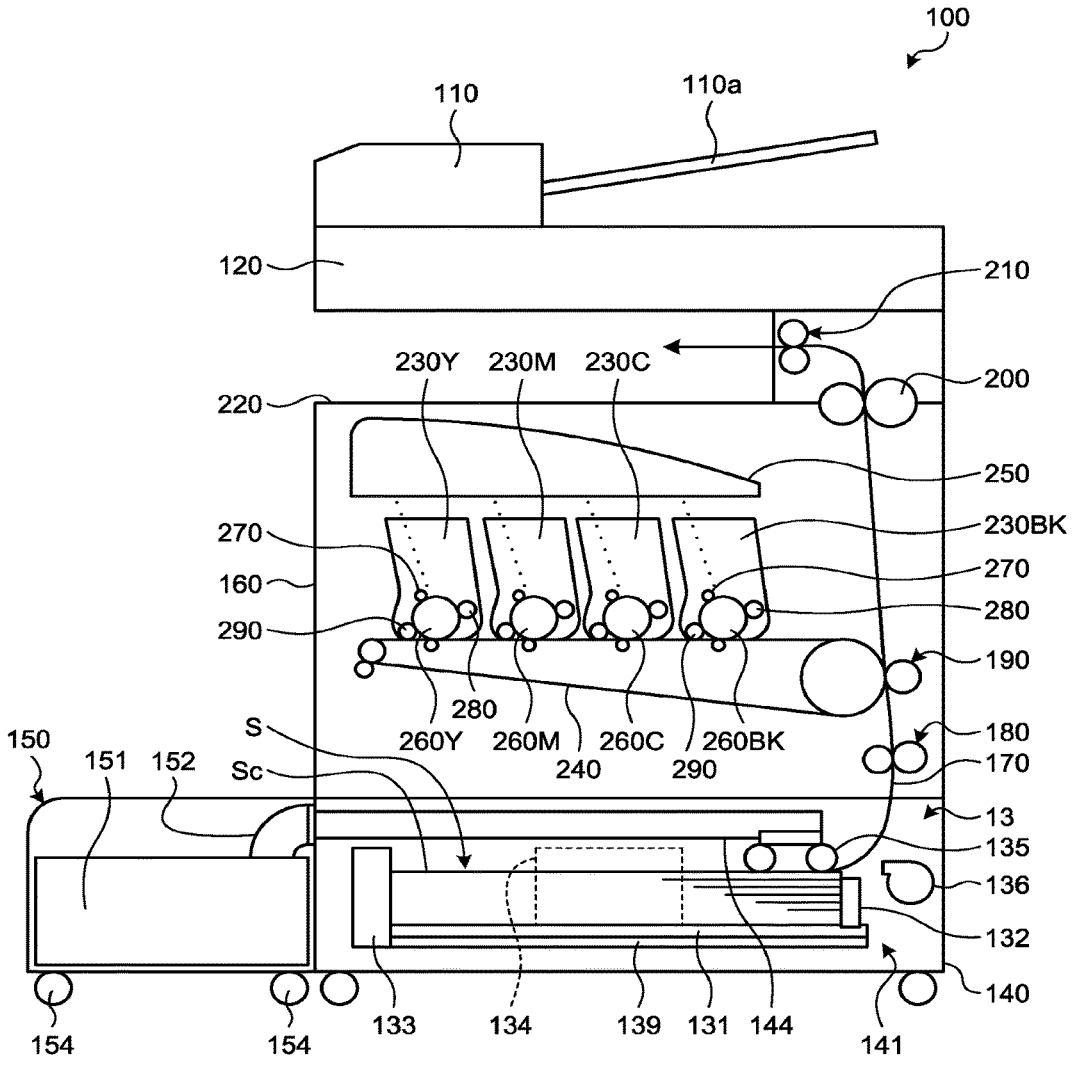
FIG. 10 is a view schematically illustrating an image forming apparatus according to a third embodiment.

The following describes a third embodiment with reference to FIG. 10. FIG. 10 is a view schematically illustrating an image forming apparatus 100 according to the third embodiment. The image forming apparatus 100 is an exemplary sheet conveyance apparatus. The sheet conveyance apparatus can be applied not only to the sheet conveyance apparatus 13 that conveys prepregs according to the first embodiment, but also to the image forming apparatus 100. The image forming apparatus 100, for example, conveys paper as an exemplary sheet and forms an image on the paper.

The image forming apparatus 100 illustrated in FIG. 10 is a copier. The image forming apparatus 100 on which the sheet conveyance apparatus 13 is mounted may nonetheless be any of various types of apparatuses that perform image formation, such as a facsimile machine and a multifunction peripheral having, for example, a copying function and a facsimile function.

The image forming apparatus 100 includes an automatic document conveyance device 110 that separates one document from a document bundle disposed on a document tray 110*a* and automatically feeds the document onto a contact glass on a document reading unit 120. The image forming apparatus 100 further includes the document reading unit 120 and an image forming unit (image forming means) 160. The document reading unit 120 reads the document conveyed by the automatic document conveyance device 110. The image forming unit 160 forms on the sheet fed from the sheet conveyance apparatus 13 an image read by the document reading unit 120. The sheet conveyance apparatus 13 supplies the image forming unit 160 with an uppermost sheet Sc disposed at an uppermost position of a sheet bundle S that includes a plurality of sheets stacked one on top of another. The image forming unit 160 can be separated from the sheet conveyance apparatus 13, but may be integrated with the sheet conveyance apparatus 13.

A sheet conveyed from the sheet conveyance apparatus 13 is to be conveyed along a conveyance path 170. The sheet conveyed along the conveyance path 170 is conveyed by a conveyance roller pair 180. A toner image formed at the image forming unit 160 by a transfer roller 190 is transferred onto the sheet. The toner image is thermally transferred by a fixing unit 200. The sheet is then discharged into a paper ejection tray 220 by a paper ejection roller pair 210.

The image forming unit 160 includes four image formation parts 230 (230Y (yellow), 230M (magenta), 230C (cyan), and 230BK (black)), an intermediate transfer belt 240 as a transfer belt, and an exposure part 250.

The exposure part 250 drives a semiconductor laser in each of laser light source units to thereby emit a light beam. The light beam is generated through conversion of color-separated image data input from a personal computer, a word processor, and the like or image data of the document read by the document reading unit 120 to a corresponding light source driving signal.

The image formation parts 230Y, 230M, 230C, and 230BK are configured to form images (toner images) of respective different colors. The image formation parts 230Y, 230M, 230C, and 230BK each include, for example, a photoconductor 260, a charging part 270, a developing part 280, and a cleaning part 290. The photoconductor 260 (260Y, 260M, 260C, and 260BK) is rotatably driven clockwise. The charging part 270, the developing part 280, and the cleaning part 290 are disposed around the photoconductor 260.

The photoconductor 260 is formed into a cylinder and driven rotatably. The photoconductor 260 has a photoconductive layer formed on an outer peripheral surface thereof. The outer peripheral surface of the photoconductor 260 is irradiated with a laser beam spot indicated by a broken line and emitted by the exposure part 250. An electrostatic latent image that corresponds to image information is thereby written on the outer peripheral surface of the photoconductor 260.

The charging part 270 uniformly charges the outer peripheral surface of the photoconductor 260. The charging part 270 is a contact type with respect to the photoconductor 260. The developing part 280 supplies the photoconductor 260 with toner. The supplied toner sticks to the electrostatic latent image written on the outer peripheral surface of the photoconductor 260. A visible toner image thus formed represents the electrostatic latent image on the photoconductor 260. The developing part 280 in the present example is a non-contact type with respect to the photoconductor 260.

The cleaning part 290 removes residual toner off the outer peripheral surface of the photoconductor 260. In the present example, the cleaning part 290 is a brush contact type including a brush that is brought into contact with the outer peripheral surface of the photoconductor 260.

The intermediate transfer belt 240 is an endless belt formed from resin film or rubber as a substrate. A toner image formed on the photoconductor 260 is transferred onto the intermediate transfer belt 240. The toner image transferred onto the intermediate transfer belt 240 is transferred by the transfer roller 190 onto the sheet.

The sheet conveyance apparatus 13 according to the third embodiment has a configuration identical to the configuration of the sheet conveyance apparatus 13 in the first or second embodiment. Specifically, FIGS. 1 to 8 can represent the sheet conveyance apparatus 13 in the third embodiment.

In the third embodiment, at least a loading stand 131 is housed in a housing chamber 141 inside a cover 140. A suction unit 150 is connected with the cover 140 and draws air in the housing chamber 141. The foregoing configurations allow the suction unit 150 to draw foreign matter on the inside of the cover 140. The foreign matter is thus prevented from being airborne inside and outside the image forming apparatus 100, the foreign matter is prevented from being deposited on the inside and the outside of the cover 140, and time required for cleaning the foreign matter is reduced.

As described above with reference to the exemplary embodiments, the sheet conveyance apparatus 13 can be applied to various types of apparatuses including the sheet conveyance apparatus 13 that conveys prepregs in the first embodiment and the image forming apparatus 100 that conveys sheets in the third embodiment. Specifically, the sheet may be any of various types of sheets including prepregs and sheets.

An embodiment achieves an effect of preventing foreign matter from being airborne.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A sheet conveyance apparatus comprising:

a placement part configured such that stacked sheets are disposed on the placement part;

a housing including an exterior wall with a first opening and means for opening and closing, the housing accommodating the placement part, at least a portion of the means for opening and closing being configured to be opened and closed; and a suction unit connected to the first opening, and configured to draw gas in an interior of the housing from the first opening.

2. The sheet conveyance apparatus according to claim 1, further comprising:

an air jet unit configured to eject air toward a sheet disposed on the placement part to float an end portion of the sheet; and a holding and conveyance member configured to hold and convey the floated sheet.

3. The sheet conveyance apparatus according to claim 2, further comprising:

a controller, operatively connected to the suction unit and the air jet unit, configured to cause the suction unit to draw the gas in the interior of the housing from the first opening while the air jet unit floats the end portion of the sheet and the conveyance member conveys the sheet.

4. The sheet conveyance apparatus according to claim 2, further comprising:

a controller, operatively connected to the suction unit and the air jet unit, configured to cause the air jet unit to supply the interior of the housing with the air and causes the suction unit to draw the gas in the interior of the housing from the first opening while a sheet floating operation by the air jet unit is stopped.

5. The sheet conveyance apparatus according to claim 2, wherein the suction unit is disposed upstream of the placement part in a conveyance direction in which the conveyance member conveys the sheet.

6. The sheet conveyance apparatus according to claim 2, wherein the means for opening and closing is disposed upstream of the placement part in a conveyance direction in which the conveyance member conveys the sheet.

7. The sheet conveyance apparatus according to claim 2, wherein the suction unit is disposed upstream of the placement part in a conveyance direction in which the conveyance member conveys the sheet, and the means for opening and closing is disposed upstream of the placement part in the conveyance direction.

8. The sheet conveyance apparatus according to claim 7, wherein the suction unit is attached to the means for opening and closing and configured to move following opening and closing of the means for opening and closing.

9. The sheet conveyance apparatus according to claim 2, wherein the suction unit is disposed upstream of the placement part in a conveyance direction in which the conveyance member conveys the sheet, and the means for opening and closing is disposed laterally with respect to the placement part in the conveyance direction.

10. The sheet conveyance apparatus according to claim 2, further comprising:

a limiting part disposed upstream of the sheet disposed on the placement part in a conveyance direction in which the conveyance member conveys the sheet, and configured to restrict the sheet from moving upstream in the conveyance direction, wherein the suction unit is disposed upstream of the limiting part in the conveyance direction.

11. The sheet conveyance apparatus according to claim 1, wherein the suction unit has a connection port configured to be connected with the housing and is removable from the housing.

12. The sheet conveyance apparatus according to claim 1, further comprising:

a filter configured to remove foreign matter from the gas drawn by the suction unit.

13. The sheet conveyance apparatus according to claim 1, further comprising:

a filter configured to remove foreign matter from the gas drawn by the suction unit, wherein the suction unit has a connection port configured to be connected with the housing and is removable from the housing, and the filter is attached in the suction unit and is removable from the suction unit through the connection port.

14. The sheet conveyance apparatus according to claim 1, further comprising:

a suction conveyance belt with a plurality of holes and configured to draw gas from the plurality of holes to hold a sheet of the stacked sheets, and convey the sheet;

a chamber inside the suction conveyance belt and connected to the plurality of holes; and an internal duct connecting the chamber to a second opening in the exterior wall of the housing, wherein the suction unit is also connected to the second opening.

15. The sheet conveyance apparatus according to claim 14, further comprising:

an internal blower configured to draw gas from the chamber to the internal duct and supply gas from the internal duct to the chamber.

16. The sheet conveyance apparatus according to claim 15, further comprising:

a controller, operatively connected to the suction unit and the internal blower, configured to cause the internal blower to supply gas to the chamber to blow out gas from the plurality of holes of the suction conveyance belt, and cause the suction unit to draw the gas in the interior of the housing from the second opening.

* * * * *